US010474111B2

(12) United States Patent
Larkin

(10) Patent No.: US 10,474,111 B2
(45) Date of Patent: Nov. 12, 2019

(54) ALARM CLOCK WITH CHALLENGING ALARM DEACTIVATION

(71) Applicant: Andrew Larkin, Waltham, MA (US)

(72) Inventor: Andrew Larkin, Waltham, MA (US)

( * ) Notice: Subject to any disclaimer, the term of this patent is extended or adjusted under 35 U.S.C. 154(b) by 0 days.

(21) Appl. No.: 16/205,156

(22) Filed: Nov. 29, 2018

(65) Prior Publication Data

US 2019/0163143 A1 May 30, 2019

Related U.S. Application Data

(60) Provisional application No. 62/593,039, filed on Nov. 30, 2017.

(51) Int. Cl.

| | |
|---|---|
| ***G04G 21/08*** | (2010.01) |
| ***G04G 13/02*** | (2006.01) |
| ***G04G 21/02*** | (2010.01) |
| ***G04G 17/08*** | (2006.01) |

(52) U.S. Cl.

CPC ..... *G04G 13/021* (2013.01); *G04G 17/08* (2013.01); *G04G 21/025* (2013.01); *G04G 21/08* (2013.01)

(58) Field of Classification Search

CPC ..... G04B 23/00; G04B 23/03; G04C 21/00; G04C 21/38

See application file for complete search history.

(56) References Cited

U.S. PATENT DOCUMENTS

| | | | | | |
|---|---|---|---|---|---|
| 3,498,047 | A * | 3/1970 | Roszyk | G04C 21/38 | 250/221 |
| 4,352,171 | A | 9/1982 | Jetter | | |
| 4,426,157 | A | 1/1984 | Jetter | | |
| 4,585,358 | A | 4/1986 | Shay | | |
| 4,747,087 | A * | 5/1988 | Sakuma | G04B 23/03 | 368/262 |
| 7,868,743 | B1 | 1/2011 | Brown | | |
| 8,717,856 | B2 | 5/2014 | Lin et al. | | |
| 9,123,483 | B2 * | 9/2015 | Ferri | H01H 13/06 | |
| 2006/0250895 | A1 * | 11/2006 | Sanchez | G04G 11/00 | 368/29 |
| 2008/0084790 | A1 * | 4/2008 | McKee | G04B 19/26 | 368/10 |
| 2010/0097227 | A1 * | 4/2010 | Kim | G04C 21/16 | 340/575 |
| 2013/0163395 | A1 * | 6/2013 | Ferri | H01H 13/06 | 368/290 |

(Continued)

*Primary Examiner* — Sean P Kayes
(74) *Attorney, Agent, or Firm* — Matthew M. Yospin; Law Office of Matthew M. Yospin

(57) ABSTRACT

Apparatus for an alarm clock with one or more alarms that are challenging to deactivate are provided. The alarm clock is fixedly attached to a wall or other surface, and contains a power source such that the alarm cannot be deactivated by unplugging the alarm clock or by easily removing batteries. The alarm(s) may be programmed to activate for a first length of time. To deactivate the alarm, a user must take some action to interact with the alarm clock, for a second length of time, which second length of time is sufficient for the user to become fully awake. Aspects of the alarm clock may be digital or analog, may have manual or electronic or remote controls, may have one or more alarms of different types, and may require different types of user interaction with alarm deactivation components in order to deactivate the one or more alarms.

4 Claims, 12 Drawing Sheets

(56) References Cited

U.S. PATENT DOCUMENTS

| | | | | |
|---|---|---|---|---|
| 2014/0104180 | A1* | 4/2014 | Schaffer | G06F 3/02 345/169 |
| 2015/0177704 | A1* | 6/2015 | Howell | G04G 13/02 368/10 |
| 2016/0028264 | A1* | 1/2016 | Bernhard | H02J 7/345 307/21 |

* cited by examiner

ALARM CLOCK WITH CHALLENGING ALARM DEACTIVATION

FIELD OF THE INVENTION

The presently disclosed subject matter relates to alarm clocks, and more specifically, to an alarm clock with an alarm that is difficult to deactivate such that deactivation requires activity or actions by a user for a period of time that makes it a near-certainty that the user is awake.

BACKGROUND OF THE INVENTION

For many people, waking up in the morning—or at other times of the day or night—can be a challenge. Alarm clocks are common and for many people are effective for rousing people from sleep and waking them up, typically by ringing a bell or programmed buzzer sound, by playing music or a radio station, or by turning on lights or a television. Yet some people are able to quickly and easily deactivate their alarms without fully waking, and then return to sleeping.

Depending on the type of alarm, this may mean hitting a physical or on-screen snooze button, or flipping a switch. With some alarms, that may only "snooze" the alarm, which will then re-activate in a small number of minutes, or that may turn the alarm off, either for the day, or permanently until it is re-set. As a result, people will wake up late, and likely arrive late to school, work, or other commitments. This can put the person behind schedule for the rest of the day, and often causes anxiety, stress, and embarrassment. Repeatedly pressing "snooze" or turning off an alarm also makes it hard for a person to be in a consistent sleep cycle, which can have negative implications for a person's health.

Some alarm clocks exist that are harder for a user to turn off than simply pressing a button. For instance, some require a person to take some action beyond hitting a switch to deactivate the alarm: Jetter, U.S. Pat. No. 4,352,171, requires use of a key; Jetter, U.S. Pat. No. 4,426,157, teaches an alarm clock where the user must press a switch for a period of time; Shay, U.S. Pat. No. 4,585,358, teaches an alarm clock where the user must shake the clock to deactivate the alarm; and Lin, U.S. Pat. No. 8,717,856, teaches an alarm clock where a user must touch a screen at more than one location to deactivate the alarm. But, all of those, and other, alarm clocks can be deactivated by a person while still in bed, and without reaching a waking state. For people with sleeping problems or difficulties getting up, an alarm clock must require a sufficient amount of brain or physical activity for the user to become fully awake. For these people, traditional alarm clocks often fail.

Other alarm clocks require that a user get out of bed and stand on a platform (e.g., Brown, U.S. Pat. No. 7,868,743)—and while a person can place any alarm clock farther from their bed, forcing them to get out of bed to shut it off, some people manage to get out of bed, quickly deactivate the alarm, and return to bed and sleep. Any alarm clock that requires an activity to deactivate the alarm, if the alarm clock could be brought back to the user's bed, can be deactivated by the user performing the activity from bed, even if the activity requires the activity over a non-trivial period of time, such as pressing multiple buttons in a sequence, or holding a switch for a period of time.

Finally, most alarm clocks are powered by electrical current and their alarms can be deactivated by unplugging them. While some are battery powered, the batteries are typically easy to remove, which will deactivate the alarm.

Accordingly, the problems with the prior art of alarm clocks include alarms that are easy to deactivate, alarms that do not require a user to get out of bed, alarms that do not require the user to stay out of bed while deactivating the alarm, alarm clocks that can be brought to a user's bed for deactivation, alarm clocks that can be deactivated by quickly unplugging them or by quickly removing the batteries, and alarms that require some effort to deactivate but can be deactivated quickly.

SUMMARY OF THE INVENTION

The present invention meets all these needs, by disclosing apparatus for alarms clocks that require, in order to deactivate the alarm or alarms, significant activity from a user, and activity out of the user's bed, such that the user must perform enough physical and mental activities that she or he will be awake at the end of the activities. The activity required is challenging, such that the user cannot accomplish it easily. The alarm clocks are affixed or fastened to a surface, so that the alarm clock cannot be moved while the user engages in the activity that deactivates the alarm(s)—so that the user cannot drag the alarm clock back to the user's bed while engaging in the activity that deactivates the alarm. The alarm clocks also have an internal power source that is difficult to remove, so that a user cannot deactivate the alarm(s) by easily removing or disengaging the power source. A goal of the present invention is to provide an alarm clock that is difficult enough to deactivate that a user will wake up in the course of deactivating it.

In the present invention, apparatus for alarm clocks are disclosed, in which the alarm clocks are fixed to a surface, powered by an internal power source that is difficult to remove (and which may be charged by an external cable, powered by an external crank or similar mechanism, or wired for electrical power without the use of an electrical receptacle), and sound one or more alarms that can only be deactivated by interaction with the alarm by performing an activity that will cause a person to wake up, over a period of time that is sufficient to get the person to wake up.

In one aspect of the present invention, the invention comprises an alarm clock, for fixed attachment to a wall, with an alarm that requires significant user interaction to deactivate, the alarm clock comprising: a clock body comprising a clock back case and a clock body cover, which clock body encloses: a timekeeping unit, a plurality of speakers for generating a plurality of audible alarm sounds, a display, an alarm control interface, and a power source; a plurality of clock-body-to-wall attachment points formed as part of the clock body; a plurality of clock body closure components to secure the clock back case and the clock body cover to each other; and a plurality of alarm deactivation components which comprise a plurality of handles fixedly attached to the clock body.

In one aspect of the present invention, the invention comprises an alarm clock, in which the clock body further encloses a plurality of light sources for generating a plurality of visible alarms.

In one aspect of the present invention, the invention comprises an alarm clock, in which the power source comprises a plurality of rechargeable batteries.

In one aspect of the present invention, the invention comprises an alarm clock, in which the power source comprises a receptacle for receiving electric power from an external power source.

In one aspect of the present invention, the invention comprises an alarm clock, in which the plurality of alarm deactivation components includes at least one capacitative touch sensor.

In one aspect of the present invention, the invention comprises an alarm clock, for fixed attachment to a wall, with an alarm that requires significant user interaction to deactivate, the alarm clock comprising: a clock body cover and a clock back case together comprising a clock body; a plurality of clock-body-to-wall attachment points; a plurality of clock body closure components to secure the clock back case and the clock body cover to each other; and a plurality of alarm deactivation components, which comprise a plurality of handles formed as part of the clock body, with capacitative touch sensors; in which the clock body encloses: a timekeeping unit, a plurality of speakers for generating a plurality of audible alarm sounds, a display, an alarm control interface, and a power source.

In one aspect of the present invention, the invention comprises an alarm clock, in which the clock body further encloses a plurality of light sources for generating a plurality of visible alarms.

In one aspect of the present invention, the invention comprises an alarm clock, in which the power source comprises a plurality of rechargeable batteries.

In one aspect of the present invention, the invention comprises an alarm clock, in which the power source comprises a receptacle for receiving electric power from an external power source.

In one aspect of the present invention, the invention comprises an alarm clock, for fixed attachment to a surface, with an alarm that requires significant user interaction to deactivate, the alarm clock comprising: a securely closed clock body which encloses a timekeeping unit, a plurality of alarm components, and a power source; a plurality of clock-body-to-surface attachment points; and a plurality of alarm deactivation components, for deactivating the plurality of alarm components, which alarm deactivation components are fixedly attached to the clock body.

In one aspect of the present invention, the invention comprises an alarm clock, in which the clock body comprises a clock back case and a clock body cover, which clock back case and a clock body cover are secured to each other with a plurality of clock body closure components.

In one aspect of the present invention, the invention comprises an alarm clock, in which the alarm clock further comprises a display.

In one aspect of the present invention, the invention comprises an alarm clock, in which the plurality of alarm components comprises one or more speakers for generating a plurality of audible alarm sounds.

In one aspect of the present invention, the invention comprises an alarm clock, in which the plurality of alarm components comprises one or more light sources for generating a plurality of visible alarms.

In one aspect of the present invention, the invention comprises an alarm clock, in which the clock body further encloses an alarm control interface, and the alarm control interface comprises analog controls.

In one aspect of the present invention, the invention comprises an alarm clock, in which the clock body further encloses an alarm control interface, and the alarm control interface comprises digital controls.

In one aspect of the present invention, the invention comprises an alarm clock, in which the alarm clock further comprises an alarm control interface, which alarm control interface comprises a software application.

In one aspect of the present invention, the invention comprises an alarm clock, in which the power source comprises a plurality of rechargeable batteries.

In one aspect of the present invention, the invention comprises an alarm clock, in which the power source comprises a receptacle for receiving electric power from an external power source.

In one aspect of the present invention, the invention comprises an alarm clock, in which the power source comprises a manually-operated crank to generate power.

In one aspect of the present invention, the invention comprises an alarm clock, in which the plurality of alarm deactivation components fixedly attached to the clock body include a plurality of handles.

In one aspect of the present invention, the invention comprises an alarm clock, in which the plurality of alarm deactivation components fixedly attached to the clock body includes at least one capacitative touch sensor.

In one aspect of the present invention, the invention comprises an alarm clock, in which the plurality of alarm deactivation components fixedly attached to the clock body includes at least one mechanical switch.

In one aspect of the present invention, the invention comprises an alarm clock, in which the plurality of alarm deactivation components fixedly attached to the clock body includes at least one resistive switch.

In one aspect of the present invention, the invention comprises an alarm clock, in which the plurality of alarm deactivation components fixedly attached to the clock body includes at least one light source and light detector.

In one aspect of the present invention, the invention comprises an alarm clock, in which the plurality of alarm deactivation components fixedly attached to the clock body includes at least one image recognition sensor.

In one aspect of the present invention, the invention comprises an alarm clock, in which the plurality of alarm deactivation components fixedly attached to the clock body includes at least one radar occupancy sensor.

In one aspect of the present invention, the invention comprises an alarm clock, in which the plurality of alarm deactivation components fixedly attached to the clock body includes at least one motion detection sensor.

In one aspect of the present invention, the invention comprises an alarm clock, in which the plurality of alarm deactivation components fixedly attached to the clock body includes at least one biosensor.

In one aspect of the present invention, the invention comprises an alarm clock, in which the plurality of alarm deactivation components fixedly attached to the clock body includes at least one pressure detection sensor.

These aspects of the present invention, and others disclosed in the Detailed Description of the Drawings, represent improvements on the current art. This summary is provided to introduce a selection of concepts in a simplified form that are further described below in the Detailed Description of the Drawings. This Summary is not intended to identify key features or essential features of the claimed subject matter, nor is it intended to be used to limit the scope of the claimed subject matter.

BRIEF DESCRIPTION OF THE DRAWINGS

The foregoing summary, as well as the following detailed description of various aspects, is better understood when read in conjunction with the appended drawings. For the purposes of illustration, there is shown in the drawings exemplary aspects; but the presently disclosed subject matter is not limited to the specific methods and instrumentalities disclosed. In the drawings, like reference characters generally refer to the same components or steps of the device throughout the different figures. In the following detailed description, various aspects of the present invention are described with reference to the following drawings, in which.

DETAILED DESCRIPTION OF THE DRAWINGS

Figure 1:
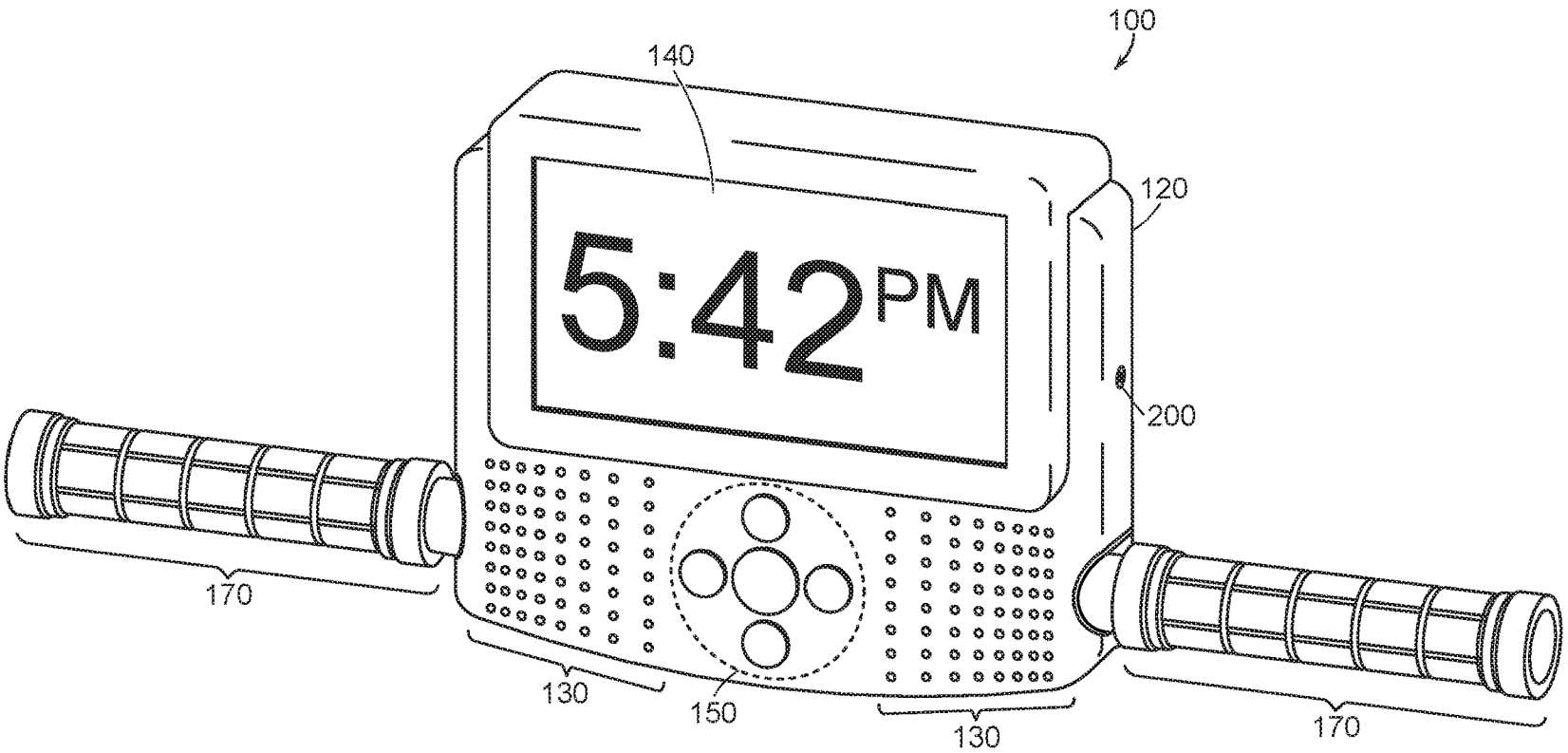
FIG. 1 shows a front perspective view of an exemplary alarm clock of the present invention.
Figure 2:
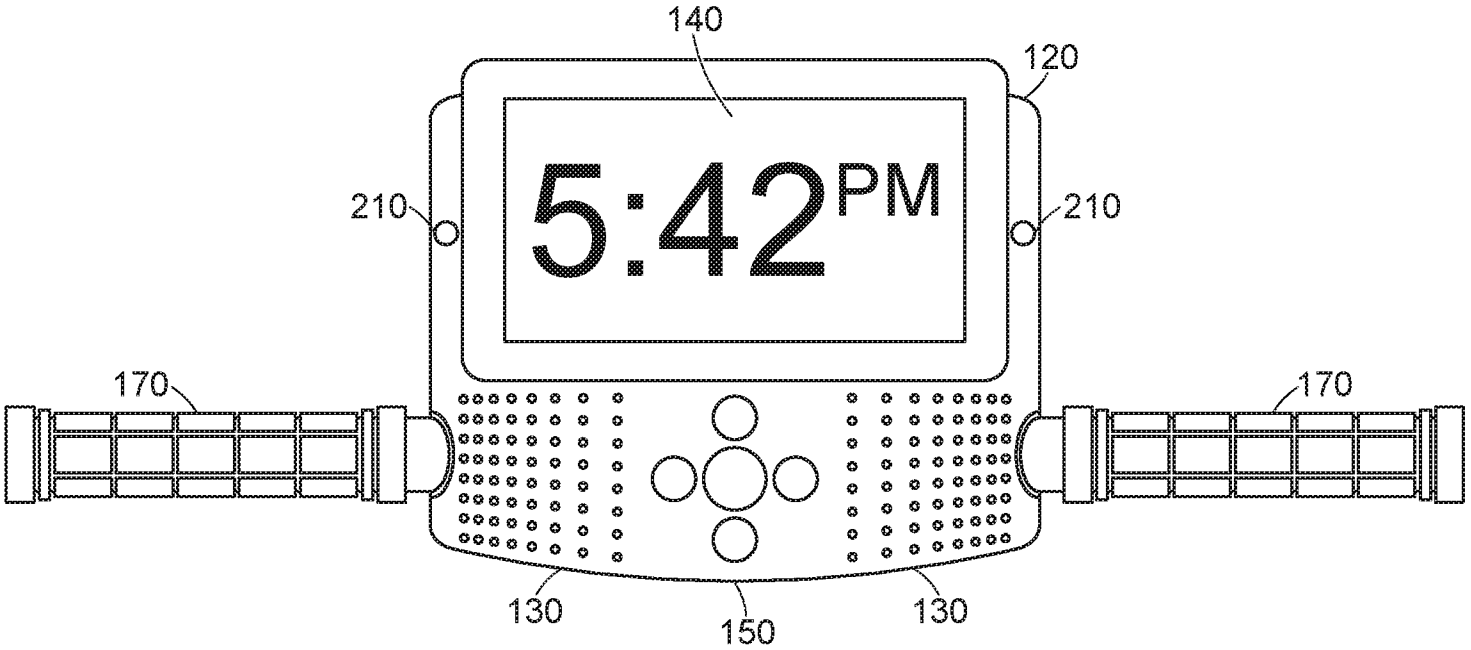
FIG. 2 shows a front elevation view of an exemplary alarm clock of the present invention.
Figure 3:
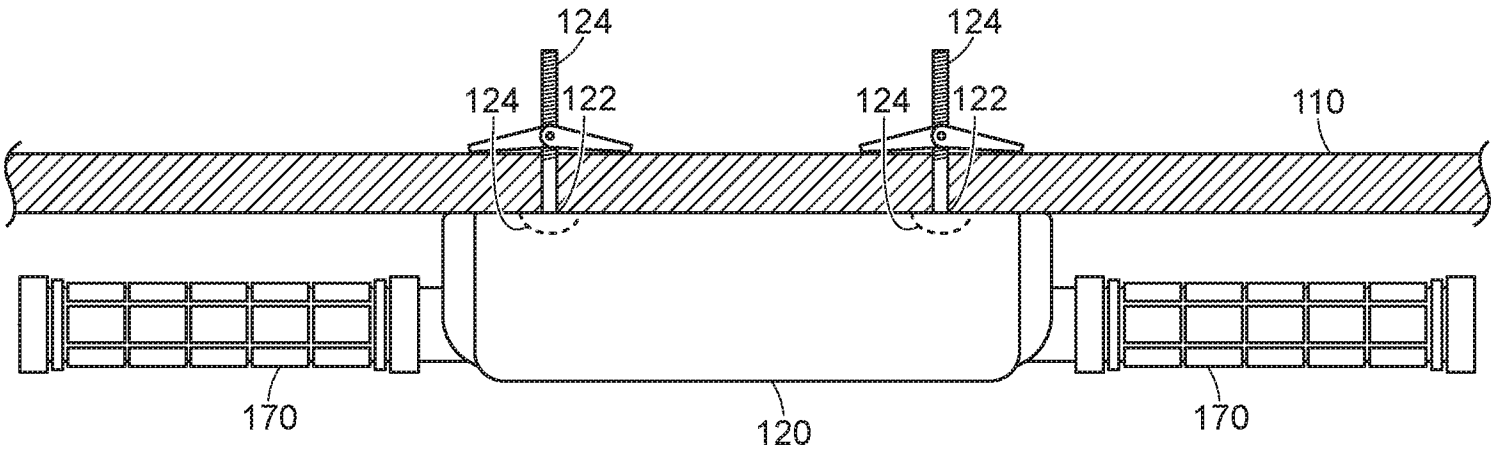
FIG. 3 shows a top elevation view of an exemplary alarm clock of the present invention, as attached to an exemplary surface.
Figure 4:
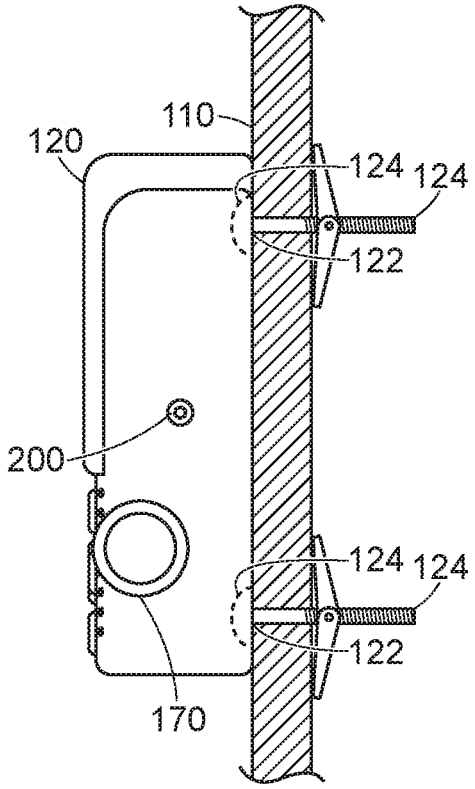
FIG. 4 shows a side elevation view of an exemplary alarm clock of the present invention, as attached to an exemplary surface.

The presently disclosed invention is described with specificity to meet statutory requirements. But, the description itself is not intended to limit the scope of this patent. Rather, the claimed invention might also be embodied in other ways, to include different steps or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

In the following description, numerous specific details are set forth to provide a thorough understanding of the invention. But, the present invention may be practiced without these specific details. Structures and techniques that would be known to one of ordinary skill in the art have not been shown in detail, in order not to obscure the invention. Referring to the figures, it is possible to see the various major elements constituting the methods and systems of the present invention.

The present subject matter discloses aspects of improved alarm clocks. At a high level of overview, the alarm clocks of the present invention are made so that they may be fixedly attached to a surface, have a power source that is difficult to remove or disengage, require significant user interaction with alarm deactivation components in order to deactivate the alarm or alarms, and of course have timekeeping and alarm functions and components for generating alarms.

In the following descriptions of the inventive methods of the present disclosure, reference is made to structures and components of an alarm clock 100; for further description of such structures and components, refer to the discussion of FIGS. 1-4, below.

FIGS. 1-4 illustrate an exemplary alarm clock 100 of the present invention. The alarm clock 100 comprises a securely closed clock body cover 120 and a clock back case 126; a plurality of clock-body-to-surface attachment points 122; and a plurality of alarm deactivation components 170, for deactivating the plurality of alarm components, which alarm deactivation components 170 are fixedly attached to the alarm clock 100. The securely closed clock body cover 120 and a clock back case 126 together comprise a clock body, and references herein to the clock body refer to the clock body cover 120 and the clock back case 126 together. The alarms of the presently-disclosed alarm clock 100 require significant user interaction in order to deactivate the alarms. As will be described below in greater detail, such interaction is significant in that it may require the user to move to a location, to stand, to press or hold or otherwise place the user's hand or hands, or other body part or body parts, in particular locations, to be visible to or in view of the alarm clock 100 and in particular to the alarm deactivation components 170, or to engage in other activities for a length of time, which length of time, it will be understood by one of skill in the art, must be sufficient in duration that the user, by performing the activity or activities comprising the significant interaction, will become fully awake during that period of time. The clock body cover 120 encloses a timekeeping unit (internal to the alarm clock 100), a plurality of alarm components 130, and a power source 160 (internal to the clock body cover 120, and not depicted in FIGS. 1-4). The clock body cover 120 may enclose or present a display 140. The clock body cover 120 may enclose or present an alarm control interface 150.

Figure 8:
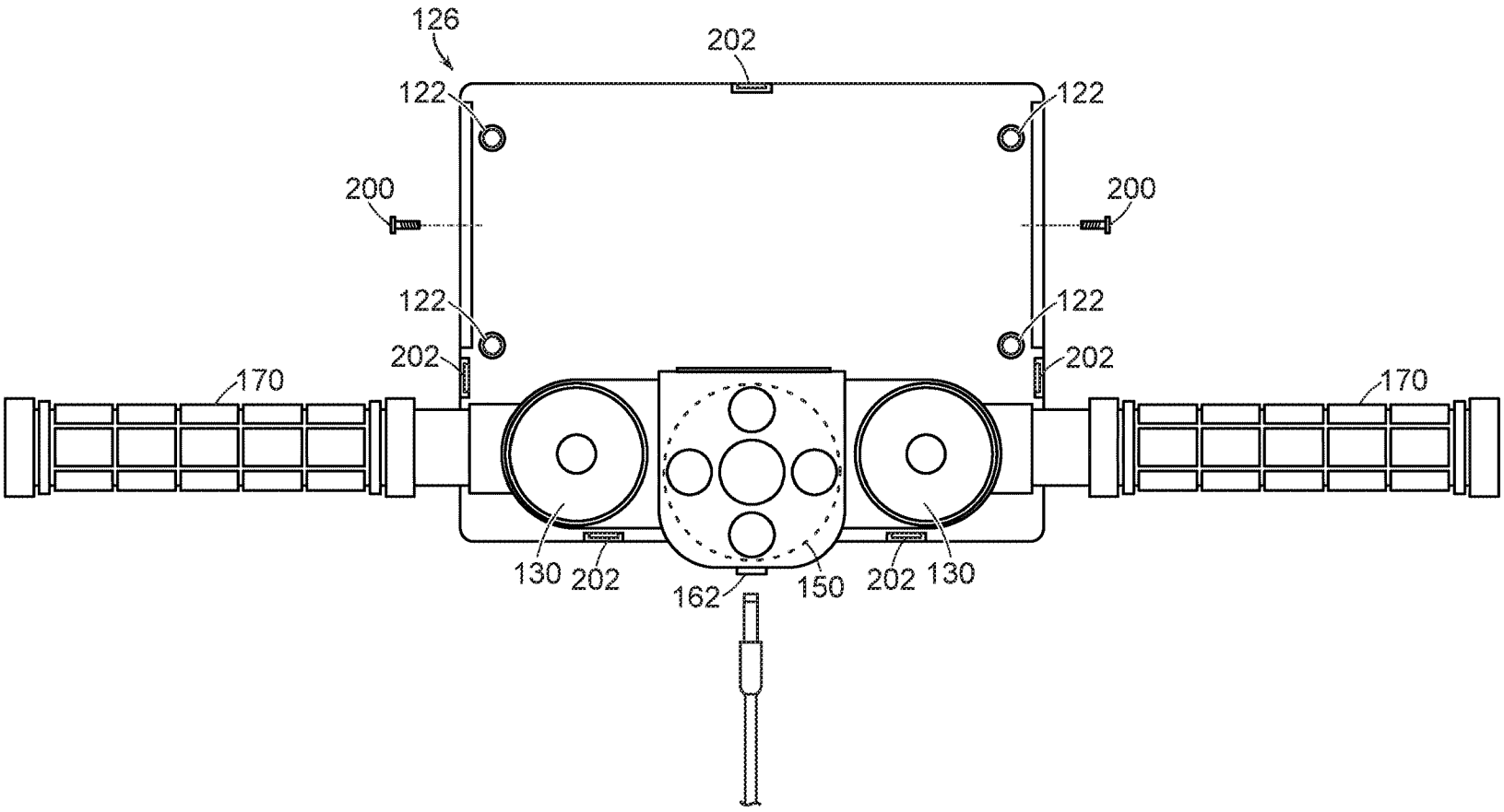
FIG. 8 shows a front elevation view of the clock back case of an exemplary alarm clock of the present invention, without the clock body cover.
Figure 9:
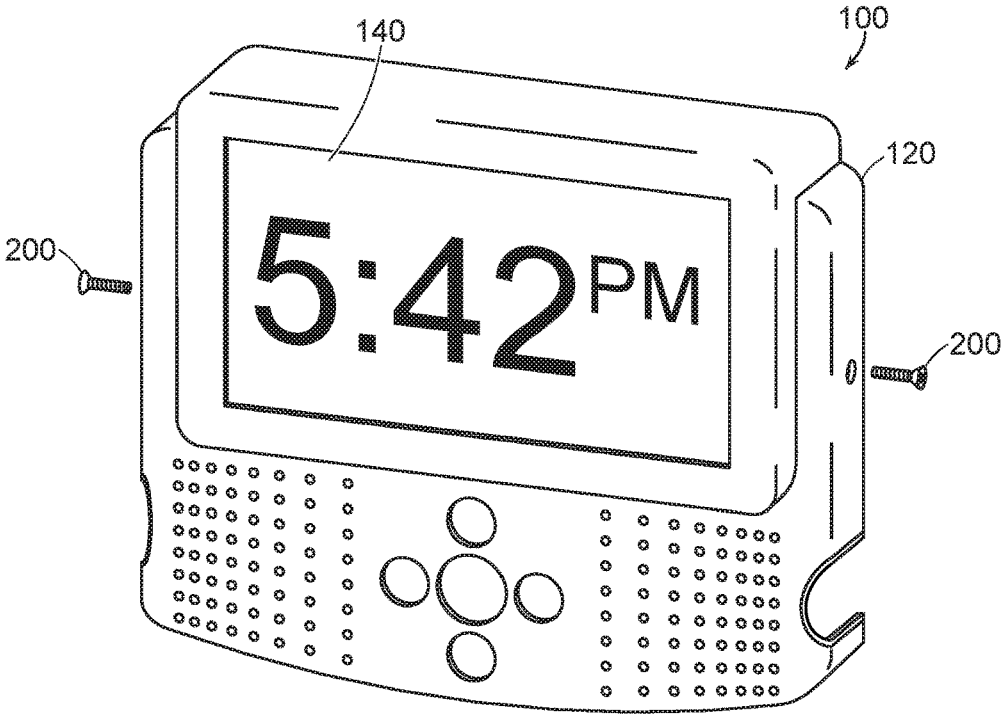
FIG. 9 shows a front perspective view of a clock body cover, removed from the clock back case, of an exemplary alarm clock of the present invention.
Figure 10:
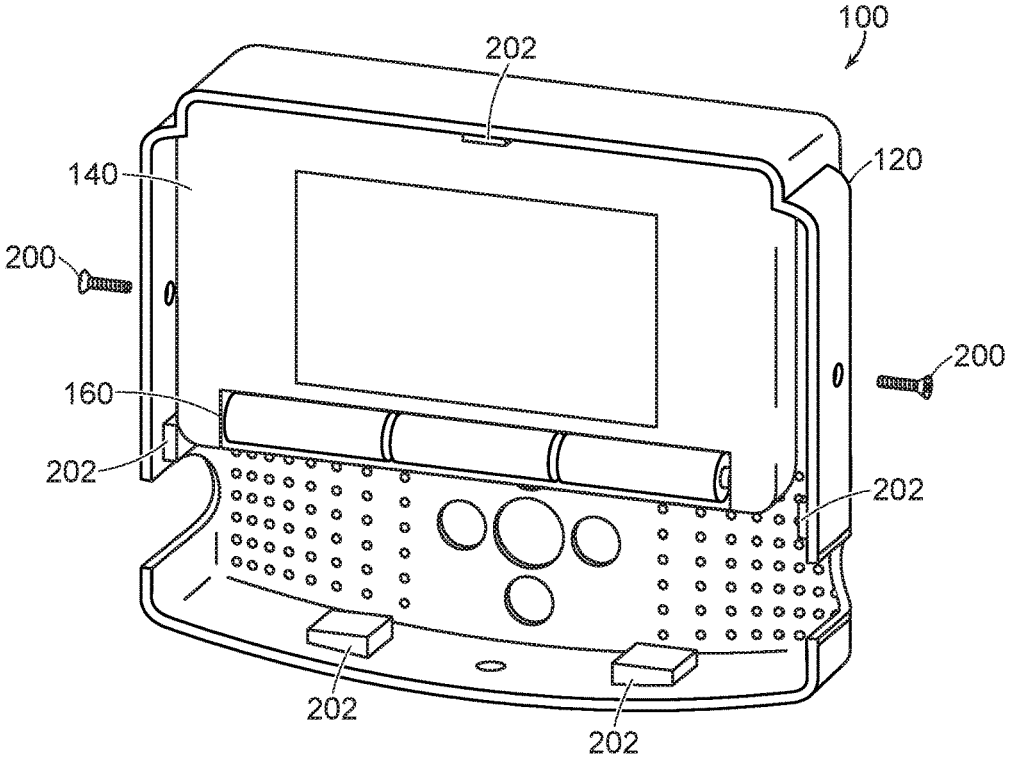
FIG. 10 shows a rear perspective view of a clock body cover, removed from the clock back case to show the inside of the clock body cover, of an exemplary alarm clock of the present invention.

With further reference to FIGS. 8-10, the clock body cover 120 is securely closed, and in some aspects of the present invention, that is achieved with a plurality of clock body closure components 200 which secure the clock body cover 120 to the clock back case 126. Such clock body closure components 200 may be screws or other fasteners with standard heads (such as slotted, Phillips, or Torx) or may be fasteners with specialty heads. The goal of the clock body closure components 200 is to make the clock body cover 120 difficult and time-consuming to open, such that a user must interact with the alarm deactivation components 170 in order to deactivate the alarm, rather than open the clock body cover 120 and disengage the power source 160 or otherwise deactivate the alarm. And, if the user does actuate the clock body closure components 200 to open the clock body cover 120, it will be understood by one of skill in the art that the activity and length of time required to do so is, as will be obvious to one of skill in the art, intended to be difficult and of sufficient duration that the user would become fully awake in the process of deactivating the alarm clock 100 in this way. The clock body cover 120 may be secured to the clock back case 126 with a plurality of clock body closure clips 202 on the clock back case 126, which engage in a locking manner with protrusions made as part of or on the clock body cover 120. As will be clear to one of skill in the art, the clock body closure clips could be on or made part of the clock body cover 120, and then engage in a locking manner with protrusions made as part of or on the clock back case 126. In some aspects of the present invention, either the clock body closure components 200 or the plurality of clock body closure clips 202 may be used. In other aspects, it will be apparent to one of skill in the art, both the clock body closure components 200 and the clock body closure clips 202 may be used to secure the clock body cover 120 to the clock back case 126.

The alarm clock 100 is made to have the alarm clock 100 securely affixed to a surface 110, and it has been found advantageous to have the clock back case 126 securely affixed to the surface 110, though one of skill in the art will see that other aspects of the present invention are possible. A suitable surface 110 may be a wall, with the alarm clock 100 mounted sufficiently far from the bed that the user must get out of bed in order to interact with the alarm clock 100. As will be understood by one of skill in the art, the alarm clock 100 may need to mounted at a height such that a user must stand to interact with the alarm deactivation components 170, so that the user cannot sit to interact and thus fall back to sleep. The surface 110 may also be a table, a dresser, a floor, a ceiling, or other suitable surface 110 that, it will be understood by one of skill in the art, will allow fixed attachment of the alarm clock 100 to the surface 110, so that a user cannot deactivate the alarm by bringing it close to the user's bed or otherwise positioning the alarm clock 100 in such a way that the user can deactivate the alarm without being sufficiently active that the user will fully wake up.

To help achieve the fixed attachment of the alarm clock 100 to the surface 110, the clock back case 126 may comprise clock-body-to-surface attachment points 122 which are used to fixedly attach the clock back case 126 to the surface 110, using clock-body-to-surface attachment components 124, which clock-body-to-surface attachment components 124 may be molly bolts, toggle bolts, screws, or any suitable fastener that cannot be easily removed (so that, as above, the user cannot deactivate the alarm by bringing it close to the user's bed or otherwise positioning the alarm clock 100 in such a way that the user can deactivate the alarm without being sufficiently active that the user will fully wake up). It will be understood by one of skill in the art that it may be advantageous to have the clock-body-to-surface attachment points 122 accessible only by removing the clock body cover 120, so that a user must open the clock body cover 120 to remove the alarm clock 100 from the clock-body-to-surface attachment components 124. In other aspects of the present invention, the clock-body-to-surface attachment components 124 may attach the alarm clock 100 to the surface 110 through holes 210 that are accessible on the exterior of the alarm clock 100. In aspects of the present invention where the surface 110 to which the alarm clock 100 is attached is a wall, the clock-body-to-surface attachment points 122 may be referred to as clock-body-to-wall attachment points 122.

In some aspects of the present invention, the timekeeping unit may be analog, in other aspects, it may be digital. In some aspects of the present invention, the plurality of alarm components 130 comprises a plurality of speakers for generating a plurality of audible alarm sounds. In other aspects, the plurality of alarm components 130 comprises one or more light sources for generating a plurality of visible alarms. The plurality of alarm components 130 may include or generate other types of alarms. The display 140 may be analog in some aspects of the presently disclosed invention, such as a rotary clock face, or may be a mechanical-digital display, or the display 140 may be digital. In some aspects of the present invention, the alarm control interface 150 may comprise digital controls or analog controls on the alarm clock 100, such as those as depicted in FIGS. 1, 2, 5, 6, 7A-7D, and 8, which alarm control interface 150 is used to set the parameters for the alarm, including but not limited to the time(s) that the alarm comes on, the duration of the alarm, and/or the length of time for which the user 500 must interact with the alarm clock 100, via the plurality of alarm deactivation components 170, to deactivate the alarm. In other aspects of the present invention, the alarm control interface 150 may comprise a software application running on a computer, which computer may be internal to the alarm clock 100, or may be external to the physical alarm clock 100 and may be a smartphone, tablet, phablet, laptop or desktop computer, or other type of computer now known or later invented. In such aspects of the present invention, the software application takes inputs from the user 500 and then communicates those inputs to the alarm clock 100 to set the parameters for the alarm, including but not limited to the time(s) that the alarm comes on, the duration of the alarm, and/or the length of time for which the user 500 must interact with the alarm clock 100, via the plurality of alarm deactivation components 170, to deactivate the alarm. In some aspects of the invention, the alarm control interface 150 may comprise i) digital and/or analog controls on the alarm clock 100, and ii) a software application running on a computer; both of which as described above. It will be apparent to one of skill in the art that other types of alarm control interface 150 may be used in the present invention.

In some aspects of the present invention, the power source 160 may comprise a plurality of rechargeable batteries internal to the clock body cover 120, so that they cannot be easily accessed for removal or deactivated. It has been found advantageous to have the power source 160 comprise, or be operably connected to, a receptacle 162 for receiving electric power from an external power source, which may power the alarm clock 100 directly or may charge batteries internal to the clock body cover 120. Other aspects of the present invention are possible, such as a manually-operated crank to generate power, which may be stored in rechargeable batteries, or which power may be stored with a mechanical apparatus, such as a spring or storage of compressed air. Such mechanical aspects may be desirable for installations of the inventive alarm clock where a backup to electrical power is desired, and/or where electrical power is not available or may be sporadic. Other aspects of the present invention are possible, such as an aspect where the alarm clock 100 is powered by a hard-wired electrical connection for power without the use of an electrical receptacle, so that a user 500 cannot deactivate the plurality of alarm components 130 by unplugging the alarm clock 100 from an electrical receptacle, if the alarm clock does not have an internal battery or batteries to power the plurality of alarm components 130 without an external source of power. It will be understood by one of skill in the art by one of skill in the art that an internal power source 160 presents other advantages, including but not limited to the functioning of the plurality of alarm components 130 in the event of a power outage or disruption in the supply of electricity.

Figure 11:
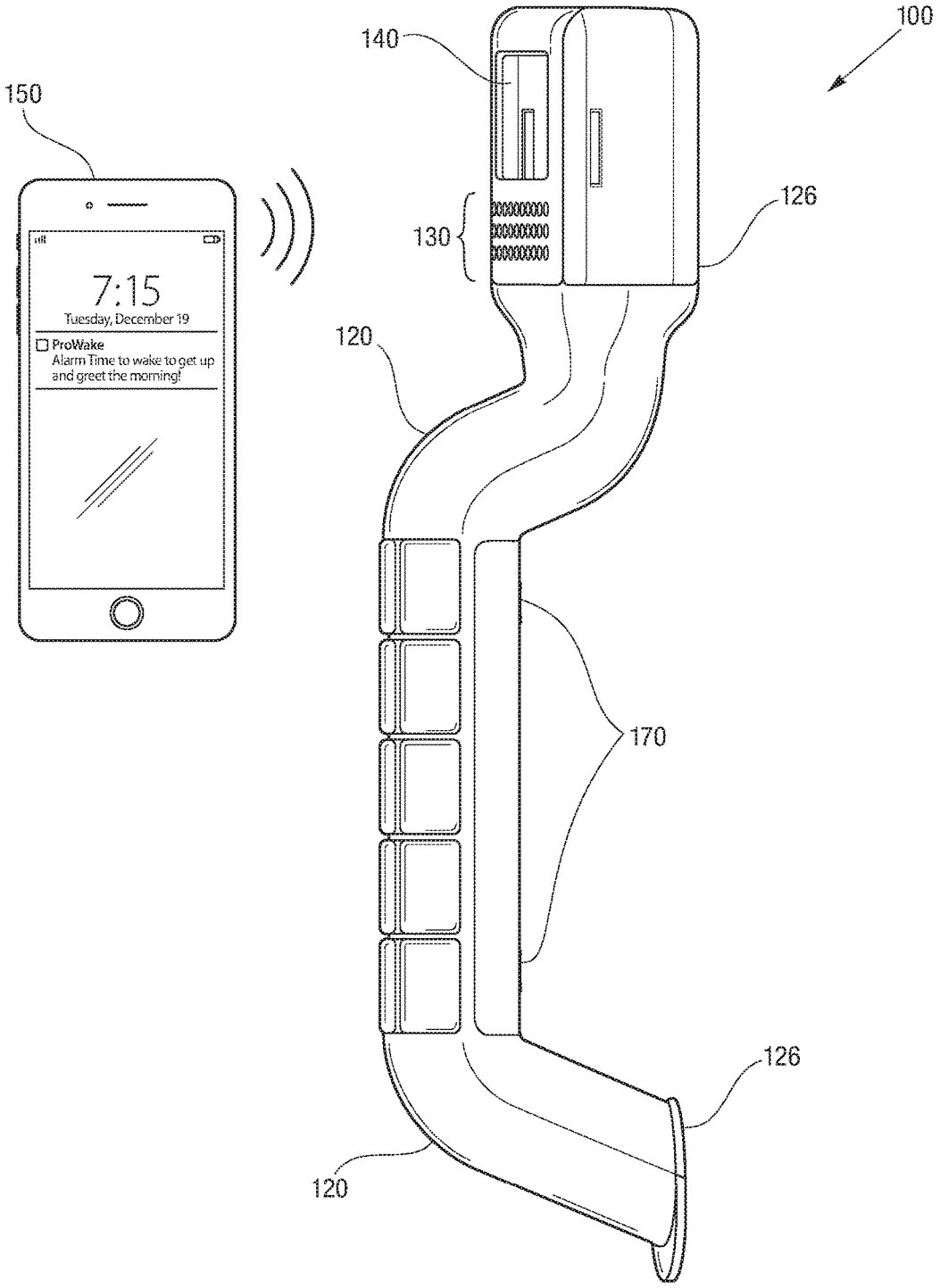
FIG. 11 shows a side perspective view of an exemplary alarm clock of the present invention, with an alarm control interface external to the alarm clock.
Figure 12:
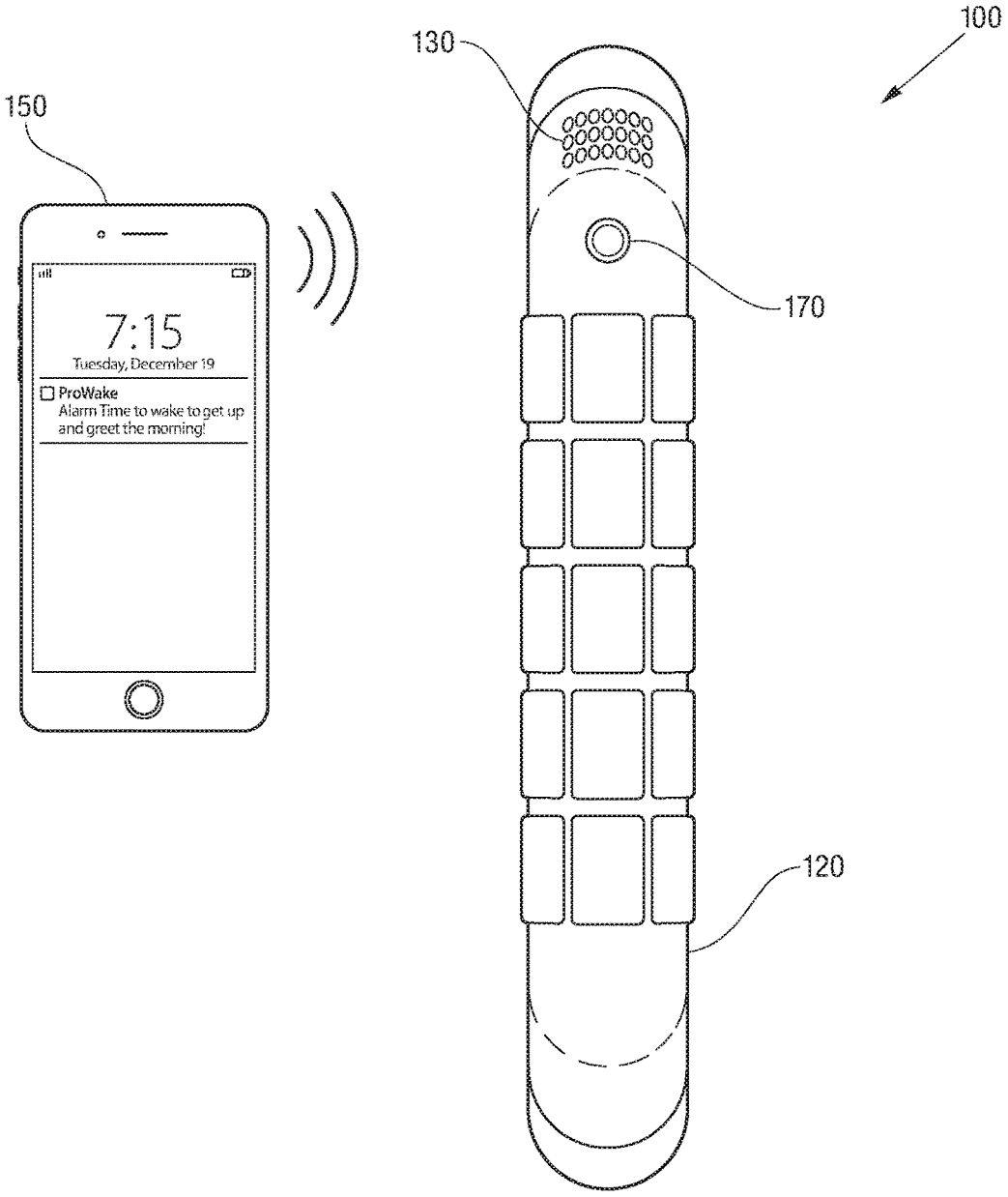
FIG. 12 shows a front elevation view of an exemplary alarm clock of the present invention, with an alarm control interface external to the alarm clock.
Figure 13:
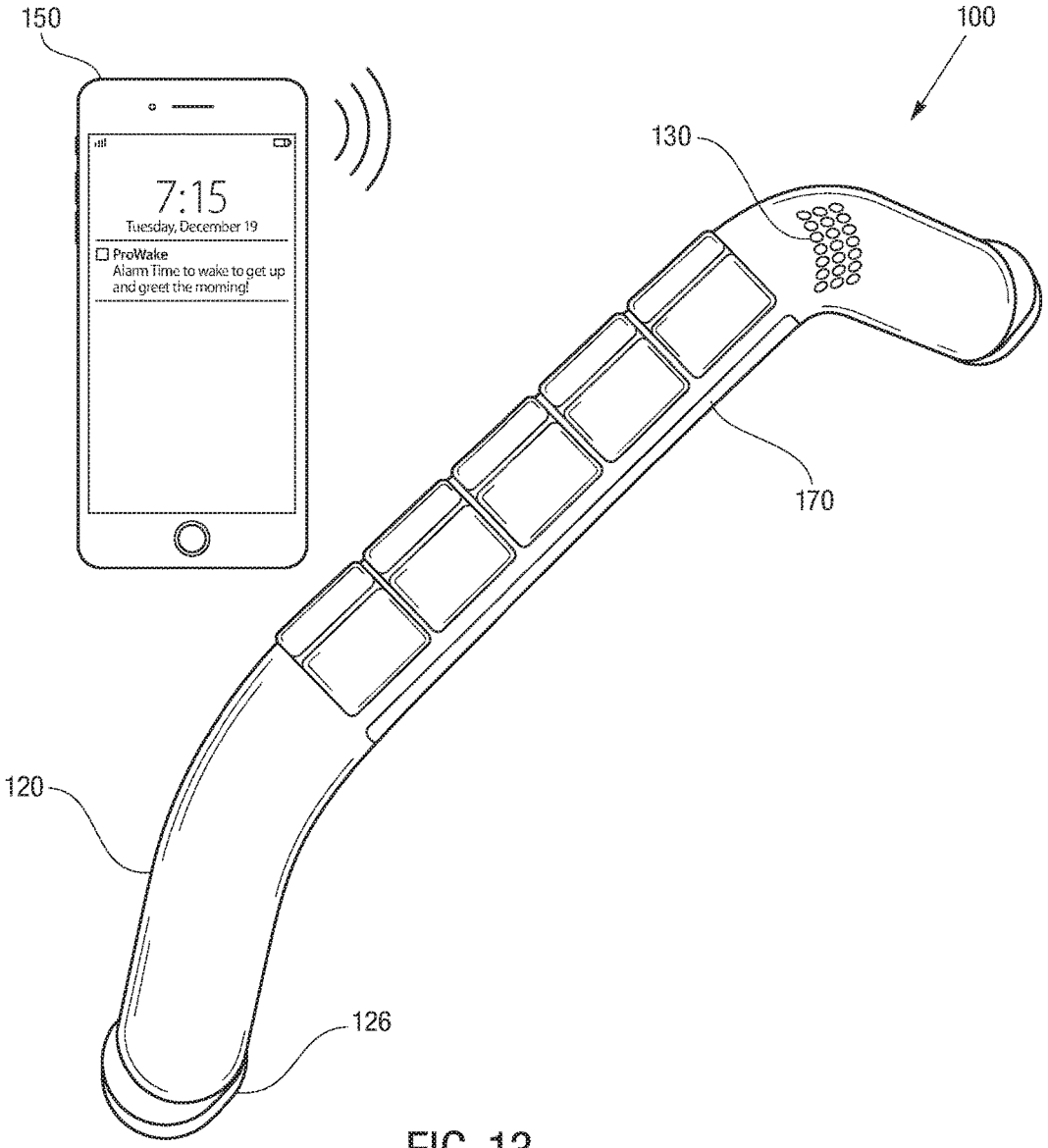
FIG. 13 shows a side perspective view of an exemplary alarm clock of the present invention, with an alarm control interface external to the alarm clock.

It has been found advantageous to have the plurality of alarm deactivation components 170 include a plurality of handles, including but not limited to the aspects of the present invention with two handles as in FIGS. 1-8, and the aspect of the present invention with one handle as in FIGS. 11-13. Such handles, or other alarm deactivation components 170, may be formed as part of the clock body or may be fixedly attached to the clock body, that is, to the clock body cover 120 and/or to the clock back case 126. It will be apparent to one of skill in the art that other numbers of handles, as the alarm deactivation components 170, and other arrangements of the relative positions of the alarm deactivation components 170, relative to the remainder of the alarm clock 100, are possible. In such aspects of the present invention, a user of the alarm clock 100 must interact with the plurality of handles for a certain period of time, sufficient to lead the user to fully wake up, in order to deactivate the alarm or alarms. The plurality of alarm deactivation components 170 may include at least one capacitative touch sensor, or may include at least one mechanical switch, or may include at least one resistive switch, or may include at least one light source and light detector, which may be visible or non-visible light, including but not limited to infrared light, or may include at least one image recognition sensor, or may include at least one biosensor including but not limited to a heart rate or a pulse monitor, or may include other types of sensors or switches, now known or later invented. The plurality of alarm deactivation components 170 may include any combination of the foregoing types of technologies for detecting a user's interaction with the alarm clock 100 via the alarm deactivation components 170, or may include other types of detectors, whether now known or later invented. It will be understood by one of skill in the art that types of alarm deactivation components 170 other than handles are possible, including but not limited to buttons, switches, a keypad or display with which a user 500 must interact or press keys, and biometric identification systems such as retinal scanners, facial recognition, voice recognition, or fingerprint recognition. In the context of the present disclosure, the term interaction is to be understood in this context to mean any holding, touching, blocking, pressing, facing, or interfering with the alarm deactivation components 170, or other type of action that makes logical sense with the type of alarm deactivation components 170 used in the particular aspect of the inventive alarm clock 100.

Figure 5:
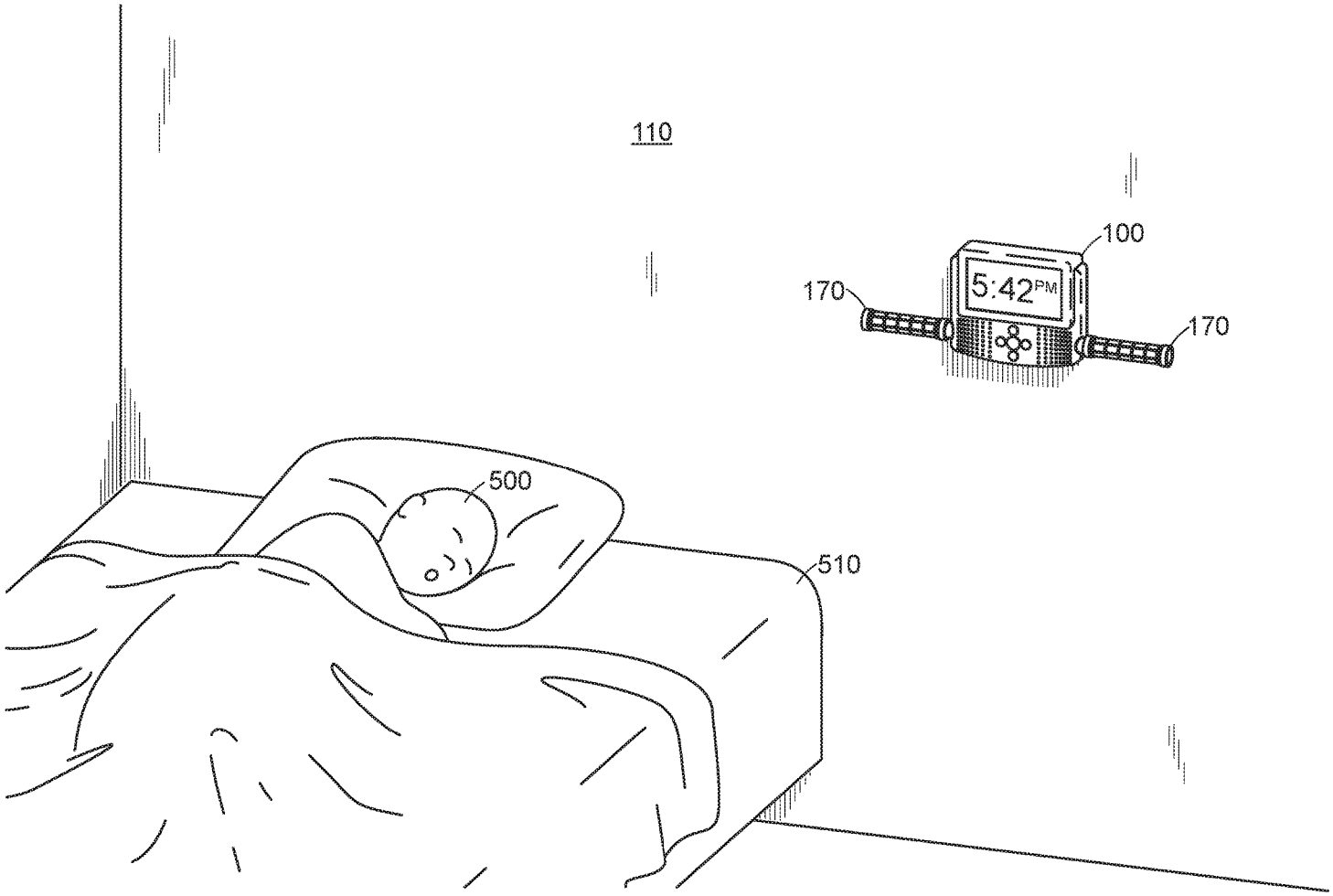
FIG. 5 shows a perspective view of an exemplary room with an installed alarm clock of the present invention.
Figure 6:
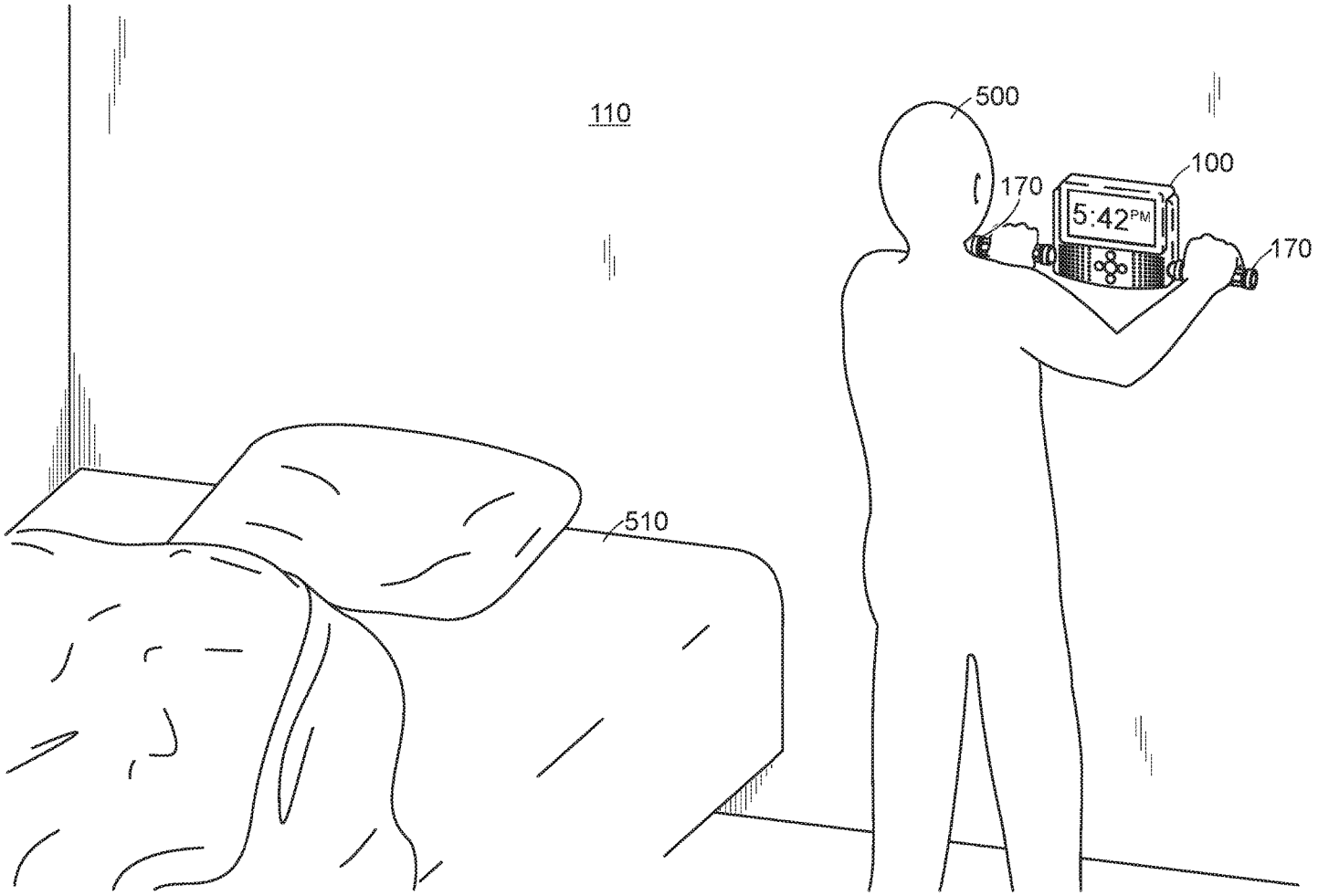
FIG. 6 shows a perspective view of an exemplary room with an installed alarm clock of the present invention, with a user awakened from bed and interacting with the exemplary alarm clock to deactivate the alarm.
Figure 7A:
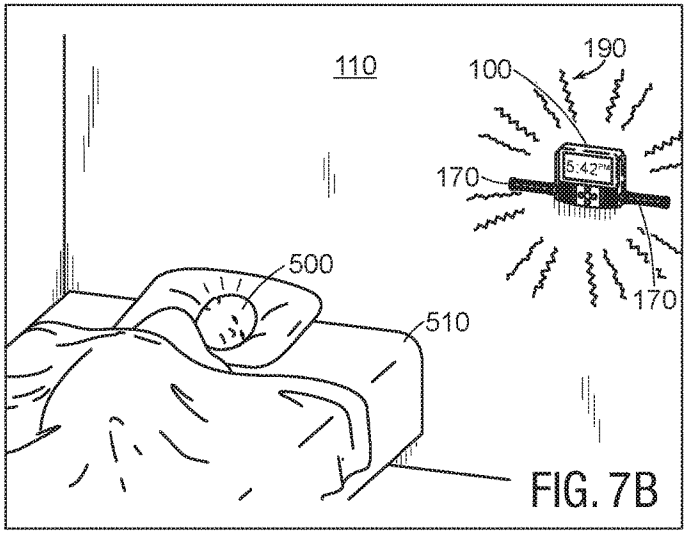
FIG. 7A shows a perspective view of an exemplary alarm clock installed in a room with a user asleep.
Figure 7B:
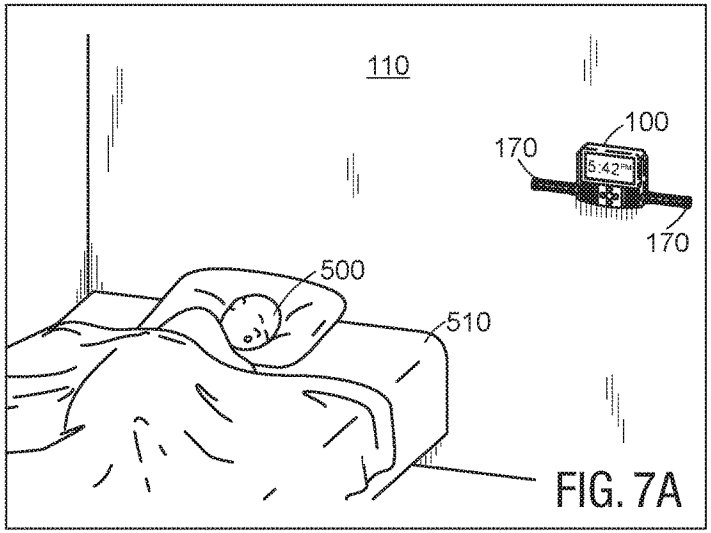
FIG. 7B shows a perspective view of an exemplary alarm clock installed in a room with the alarm activated.
Figure 7C:
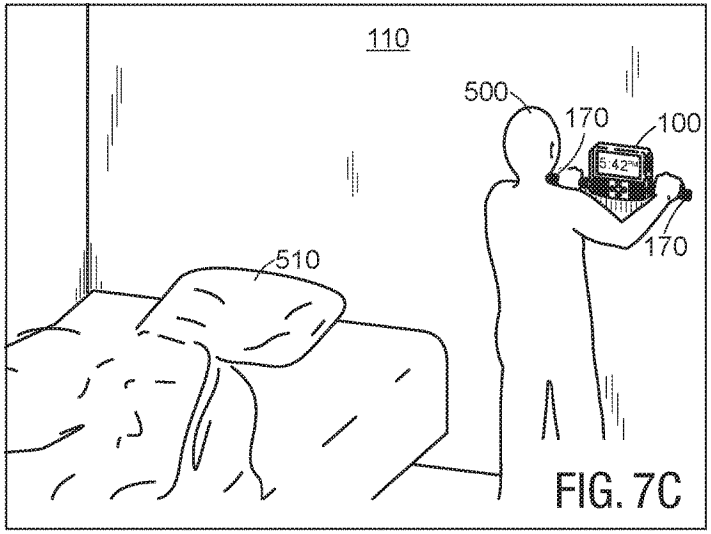
FIG. 7C shows a perspective view of an exemplary alarm clock installed in a room with a user awakened from bed and interacting with the exemplary alarm clock to deactivate the alarm.
Figure 7D:
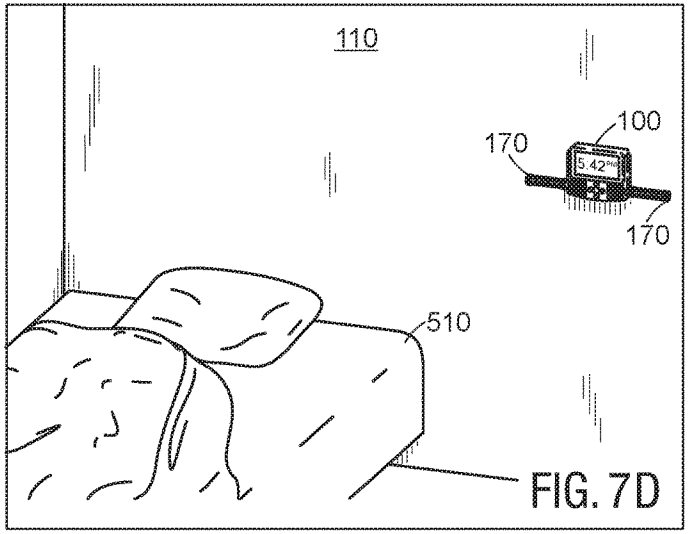
FIG. 7D shows a perspective view of an exemplary alarm clock installed in a room after a user has deactivated the alarm.

With reference to FIG. 5, a user 500 is depicted in a bed 510, with an exemplary alarm clock 100 mounted on a surface 110—in this patent illustration, the surface 110 is a wall—sufficiently far from the bed 510 that the user 500 must get out of the bed 510 in order to achieve the significant interaction with the alarm deactivation components 170 that is required in order to deactivate the alarm(s). FIG. 6 illustrates the user 500 out of the bed 510 and interacting with the alarm clock 100. FIGS. 7A-7D show the user 500 in bed 510, then upon the activation of the alarm, depicted as the alarm(s) when active 190, the user 500 rises from the bed 510, has at least one significant interaction with the alarm deactivation components 170, and having succeeded in deactivating the alarm(s) and become fully awake, leaves the room.

With reference to FIG. 8, the clock back case 126 is shown in a front elevation view, without the clock body cover 120. This view of the clock back case 126 shows the plurality of clock-body-to-surface attachment points 122, through which the plurality of clock-body-to-surface attachment components 124 may pass to securely affix the clock back case 126, and thus the alarm clock 100 after the clock body cover 120 is affixed to the clock back case 126 with the clock body closure components 200, to the surface 110. FIG. 8 depicts an exemplary receptacle 162 for connection of electrical power to the internal power source 160.

FIG. 9 shows a front perspective view of the clock body cover 120, removed from the clock back case 126. In this view, the display 140 is depicted as active. An exemplary plurality of clock body closure components 200 are depicted outside of and removed from the clock body cover 120; they would be passed through the clock body cover 120 and into the clock back case 126 to secure the clock body cover 120 to the clock back case 126. FIG. 10 shows a rear perspective view of the clock body cover 120, removed from the clock back case 126 to show the inside of the clock body cover 120. In this view, the interior of the display 140 is shown, and the clock body closure components 200 are depicted outside of the clock body cover 120, as in FIG. 9. The power source 160 is also shown, and it will be readily apparent to one of skill in the art that while the power source 160 is depicted here as what appear to be a plurality of AA or AAA batteries, any size or number of rechargeable batteries may be used as the power source 160, or the power source 160 may be of another type altogether, as described above.

FIG. 11 shows an aspect of the present invention in which the alarm clock 100 comprises a clock body cover 120, a clock back case 126, a plurality of alarm components 130, a display 140, a power source 160 (internal to the alarm clock 100 as disclosed herein and in FIG. 10 and FIG. 8, and not shown in FIGS. 11), and a plurality of alarm deactivation components 170. The alarm clock 100 may comprise a receptacle 162 (as disclosed herein and not shown in FIG. 11) for receiving electric power from an external power source, which may power the alarm clock 100 directly or may charge batteries, as the power source 160, internal to the clock body cover 120. The plurality of alarm deactivation components 170 may be, in this aspect, placed on or comprise a single handle. The clock back case 126 may be fixedly attached to a surface 110, as disclosed herein. The alarm control interface 150 may be external to the alarm clock 100, such as a software application running on a computer, as disclosed herein. A plurality of clock-body-to-surface attachment points 122 are not shown in FIG. 11, but as disclosed herein, may be used to fixedly attach the clock back case 126 to the surface 110, and a plurality of clock body closure components 200 are not shown in FIG. 11, but as disclosed herein, may be used to secure the clock body cover 120 to the clock back case 126.

FIG. 12 and FIG. 13 show an aspect of the present invention in which the alarm clock 100 comprises a clock body cover 120, a clock back case 126, a plurality of alarm components 130, a power source 160 (internal to the alarm clock 100 as disclosed herein and in FIG. 10 and FIG. 8, and not shown in FIGS. 12-13), and a plurality of alarm deactivation components 170. The alarm clock 100 may comprise a receptacle 162 (as disclosed herein and not shown in FIGS. 12-13) for receiving electric power from an external power source, which may power the alarm clock 100 directly or may charge batteries, as the power source 160, internal to the clock body cover 120. The plurality of alarm deactivation components 170 may be placed on or comprise a single handle, as shown in the aspect of the present invention in FIG. 13, and the plurality of alarm deactivation components 170 may comprise a pressure detection sensor. The plurality of alarm deactivation components 170 may comprise, as disclosed herein, an optical sensor, with or without a light source, which may be used for image recognition (such as recognition of a particular person), or for detection of the presence of a reflection or light-blocking object (such as a person) including but not limited to a radar occupancy sensor or an ultrasound occupancy sensor such as could be used to detect whether a person is standing or seating within a required proximity of the alarm clock 100, or may be some other type of photon detector or biosensor, such as the alarm deactivation components 170 illustrated in FIG. 12. The alarm deactivation components 170 may comprise a motion detection sensor, which may be used in aspects of the alarm clock 100 in which the user 500 is required to be in motion for a period of time in order to deactivate the plurality of alarm components 130. The clock back case 126 may be fixedly attached to a surface 110, as disclosed herein. The alarm control interface 150 may be external to the alarm clock 100, such as a software application running on a computer, as disclosed herein. A plurality of clock-body-to-surface attachment points 122 are not shown in FIGS. 12-13, but as disclosed herein, may be used to fixedly attach the clock back case 126 to the surface 110, and a plurality of clock body closure components 200 are not shown in FIGS. 12-13, but as disclosed herein, may be used to secure the clock body cover 120 to the clock back case 126. In the aspects of the present invention illustrated in FIGS. 12-13, the alarm clock 100 does not comprise a display 140. The functions of a display 140 may be implemented in the alarm control interface 150, such as by having the software application running on the exemplary computer implement controls for setting a current time of day, an alarm time or alarm times, an alarm duration, and alarm parameters including but not limited to lights, sounds, and choices for alarm intensity or volume, duration, and modulation of the foregoing options for the alarm parameters.

Certain aspects of the present invention were described above. From the foregoing it will be seen that this invention is one well adapted to attain all the ends and objects set forth above, together with other advantages, which are obvious and inherent to the system and method of the present invention. It will be understood that certain features and sub-combinations are of utility and may be employed without reference to other features and sub-combinations. It is expressly noted that the present invention is not limited to those aspects described above, but rather the intention is that additions and modifications to what was expressly described herein are also included within the scope of the invention. Moreover, it is to be understood that the features of the various aspects described herein are not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

What is claimed is:

1. An alarm clock, for fixed attachment to a wall, with an alarm that requires significant user interaction to deactivate, the alarm clock comprising:

a clock body cover and a clock back case together comprising a clock body;

a plurality of clock-body-to-wall attachment points;

a plurality of clock body closure components to secure the clock back case and the clock body cover to each other; and a plurality of alarm deactivation components, which comprise a plurality of handles formed as part of the clock body, with capacitative touch sensors;

in which the clock body encloses:

a timekeeping unit, a plurality of speakers for generating a plurality of audible alarm sounds, a display, an alarm control interface, and a power source.

2. The alarm clock of claim 1, in which the clock body further encloses a plurality of light sources for generating a plurality of visible alarms.

3. The alarm clock of claim 1, in which the power source comprises a plurality of rechargeable batteries.

4. The alarm clock of claim 1, in which the power source comprises a receptacle for receiving electric power from an external power source.

* * * * *